United States Patent [19]

Vögeli

[11] 3,972,167

[45] Aug. 3, 1976

[54] WALL SYSTEM OF TWO PARALLEL SPACED PANELS

[75] Inventor: Ernst Vögeli, Zurich, Switzerland

[73] Assignee: Polio Establishment, Vaduz, Liechtenstein

[22] Filed: Feb. 11, 1974

[21] Appl. No.: 441,332

[30] Foreign Application Priority Data

Feb. 10, 1973 Switzerland ..... 1921/73

[52] U.S. Cl. ..... 52/481; 52/241; 52/407; 52/483; 52/574; 52/586

[51] Int. Cl.² ..... E04B 2/28; E04B 2/74

[58] Field of Search ..... 52/479, 407, 172, 460, 52/281, 481, 398, 483, 399, 586, 406, 574, 241

[56] References Cited

UNITED STATES PATENTS

| | | | |
|---|---|---|---|
| 1,693,655 | 12/1928 | Murphy | 52/481 X |
| 2,169,254 | 8/1939 | Kotrabaty | 52/481 X |
| 2,228,363 | 1/1941 | Pinney | 52/281 X |
| 2,424,547 | 7/1947 | Behin | 52/479 |
| 2,922,201 | 1/1960 | Baker | 52/241 |
| 3,018,859 | 1/1962 | Struben | 52/479 |
| 3,336,710 | 8/1967 | Raynes | 52/586 X |
| 3,537,217 | 11/1970 | Lickliter | 52/481 X |
| 3,611,653 | 10/1971 | Zinn | 52/241 |
| 3,640,039 | 2/1972 | McKee et al. | 52/281 |
| 3,700,385 | 10/1972 | Sherwood | 52/479 X |
| 3,789,567 | 2/1974 | Rae et al. | 52/588 X |

FOREIGN PATENTS OR APPLICATIONS

| | | | |
|---|---|---|---|
| 631,064 | 8/1963 | Belgium | 52/241 |
| 1,301,778 | 7/1962 | France | 52/479 |
| 1,330,816 | 3/1963 | France | 52/460 |
| 706,632 | 4/1941 | Germany | 52/479 |
| 6,401,213 | 8/1965 | Netherlands | 52/481 |

*Primary Examiner*—Ernest R. Purser
*Assistant Examiner*—Leslie A. Braun
*Attorney, Agent, or Firm*—Michael J. Striker

[57] ABSTRACT

A wall system comprises a plurality of supporting frames and a plurality of wall panels associated in pairs with each respective frame. The two panels of each pair are interconnected in the regions of their upright marginal portions so as to extend in mutual parallelism and to define a space in which the upright supports of the associated frame are accommodated with clearance from each of the panels. An insulating member is accommodated between one upright support and one of the panels, and another insulating member is accommodated between the other upright support and the other panel. The upright marginal portions of any two adjacent pairs of panels are interconnected in mutual alignment in such a manner that the insulating member associated with the upright support of one pair of panels is situated at the opposite side of the upright support from the side of the upright support of the other pair of panels at which the other insulating member is located so that mediate contact between the two panels of each pair is avoided without sacrificing the stability of the system. The upright supports of each frame are interconnected by transverse beams on which the pair of panels is supported with clearance. Additional rails and rollers may be provided when the wall system is to be used as a sliding partition.

14 Claims, 5 Drawing Figures

WALL SYSTEM OF TWO PARALLEL SPACED PANELS

BACKGROUND OF THE INVENTION

The present invention relates to wall systems in general, and more particularly to a wall system which has pronounced sound absorbing, heat insulating and fire retarding properties. Still more particularly, the present invention relates to a wall system which may be used either as a permanent, a temporary or a slidable partitioning wall.

Various wall systems are well known in the building industry and they have found widespread application. One of the main requirements for such systems is that they have good sound absorbing, heat insulating and fire retarding properties, whether such wall systems are used as permanent parts of the building structure, as dismountable partitions or as slidable partitioning walls. However, these requirements are not fully met even if the wall system is a solid masonry wall made of sound-absorbing and thermally insulating fireproof material; these requirements are even more difficult to meet in relatively thin partitioning wall systems. This results from the fact that the walls are at least partially permeable to sound and/or heat due to the immediate or mediate connection between the two opposite major surfaces of the wall facing the compartments being separated from one another by the wall or, in case of an outside wall, one of the surfaces facing the exterior of the building.

Attempts have already been made to reduce the permeability of wall systems to pentration of sound and heat therethrough by providing a hollow insulating space inside the wall system which effectively separates one wall portion facing one of the compartments from another wall portion facing the other compartment or the exterior of the building. As a result of this arrangement, the heat and sound transmission through the wall system has been significantly reduced since the heat and sound conduction occurs predominantly through connecting portions or elements of the wall which bridge the hollow space and connect the two major wall portions to one another. Since these connecting portions or elements have a relatively small cross-sectional area, the heat and sound conduction therethrough is insignificant when compared to that of a solid wall but not negligible. In fact, the amount of heat and the intensity of sound penetrating through such hollow wall are still substantial. While the temperature drop between two neighboring compartments may be small so that the heat insulating properties of the wall system may not be of real significance in some wall systems, particularly in partitioning wall systems erected inside a building, the problem of sound penetration is to be avoided in such wall systems whether they are used as exterior or as partitioning walls, and particularly in the latter case.

There are also already known wall constructions or systems in which two independently supported wall panels are provided which have neither immediate nor mediate contact with one another. However, these systems have up to now been utilized only for erecting permanent or at most dismountable partitioning or other walls, not for slidable partitioning walls. In addition thereto, all the parts of which the wall system of this type is to be assembled have to be transported separately to the building site. Consequently, the erection of such a wall system requires utilization of highly skilled labor force and involves considerable time expenditure. Consequently, it would be advantageous to mount a pair of wall panels on a shared supporting frame to form a wall element since then the erection of a partitioning wall would only involve arranging a plurality of such wall elements in mutual alignment and interconnecting the same; however, all of the heretofore known wall elements of this type have invariably involved formation of bridges between the two associated panels mounted on the same frame, with attendant deterioration of the sound and heat insulation properties of the wall due to the fact that the two panels are mounted on the same supporting columns or transverse beams which together form the frame.

SUMMARY OF THE INVENTION

Accordingly, it is an object of the present invention to avoid the disadvantages of the prior art wall systems.

More particularly, it is an object of the present invention to provide a composite wall element to be used in a wall system which has excellent sound absorbing, thermally insulating and fire retarding properties.

It is a further object of the present invention to provide a wall element comprising two wall panels mounted on a shared frame.

It is an additional object of the present invention to provide a wall element which may be moved as a unit and easily and reliably connected with another wall element to together form a wall system.

It is a concomitant object of the present invention to provide a wall element comprising two wall panels mounted on a shared frame without immediate connection of the two panels to one another.

It is yet another object of the present invention to provide a wall element which can be used either as a part of a stationary partition wall or in a sliding wall.

In pursuance of these objects and others which will become apparent hereinafter, one feature of the present invention resides in providing a wall element having a frame made of metallic, synthetic plastic or similar material and having two upright supports on which two simple or composite wall panels are mounted in such a manner that each panel is supported at only one of the upright supports of the frame while it is spaced a certain distance from the other upright support on which the other panel is supported. Connecting elements are provided which connect the upright marginal portions of the two associated wall panels to one another and, when more than one of the wall elements are arranged next to one another in mutual alignment to form a wall system, to connect the marginal portions of the two adjacent wall elements to one another. In the latter case, the marginal portion of the panel of one of the wall elements which is spaced from the upright support abuts and is connected to the marginal portion of the adjacent panel of the other wall element which is supported on its associated upright support so that proper alignment of the wall panels and wall elements is assured.

In a currently preferred embodiment of the invention, the panels of each of the wall elements are also mounted on the horizontal or transverse bars interconnecting the upright supports and forming with the latter the frame in such a manner that at least one gap is provided between the respective wall panel and the associated transverse bar, so that no heat or sound transmitting bridges are provided between the panels of the wall element and the frame thereof.

According to the currently preferred embodiment of the invention, the connecting elements which connect the two panels of the wall element to one another and possibly also to the adjacent panels are made of sound-absorbing material so as to prevent transmission of sound from one of the panels of each wall element to the other one through the connecting elements. If the wall element has to have fire-retarding properties, the wall panels and the frame are made of fire-proof materials.

The wall element or a plurality of interconnected wall elements according to the invention may either be used as a stationary, possibly dismountable partitioning wall or, alternatively, may be mounted for sliding on overhead or bottom rails in a conventional manner so as to provide a sliding door or a disappearing partitioning wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
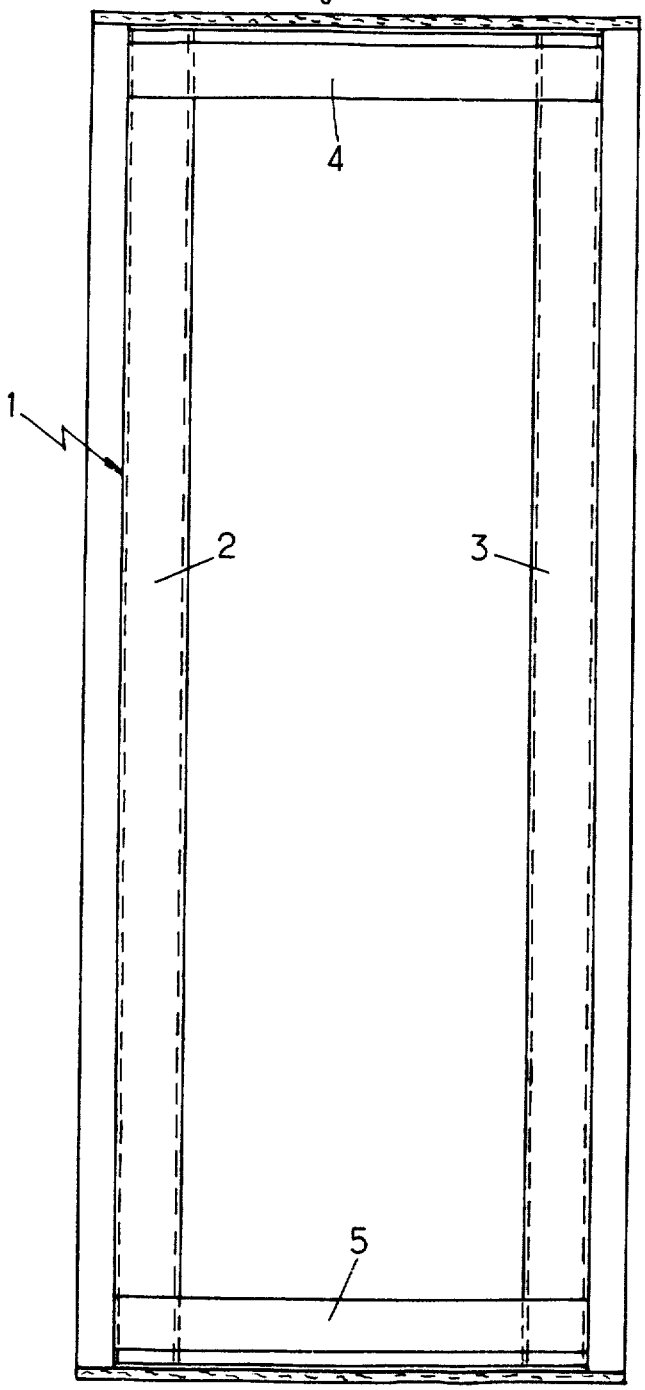
FIG. 1 is a front elevational view of the wall element according to the invention with the front panel omitted.
Figure 2:
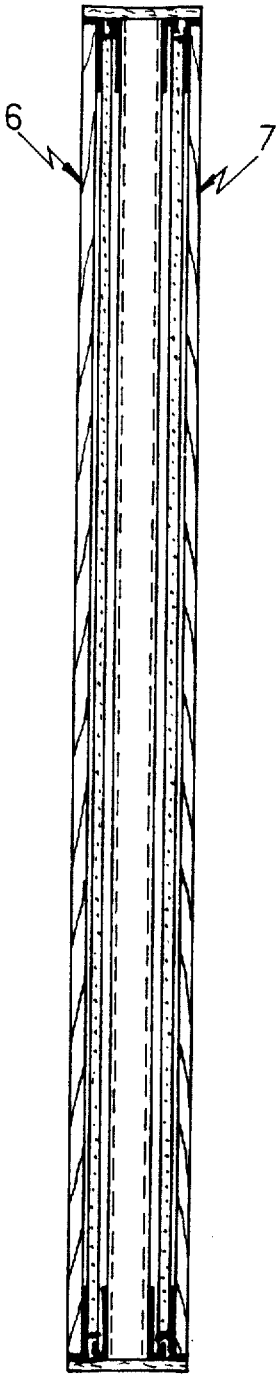
FIG. 2 is a side elevational view of the wall element according to the invention with the connecting elements omitted.

Referring now to the drawings and firstly to FIGS. 1 and 2 thereof, it may be seen therein that a composite wall element according to the invention comprises a frame 1 which includes two upright supports 2 and 3 which are interconnected by transverse bars 4 and 5. The upright supports 2, 3 and the transverse bars 4, 5 may preferably be made of interconnected profiled metallic or synthetic plastic material sections of rectangular or similar configuration. Two wall panels 6 and 7 are mounted on the frame 1 in a manner which will now be described in detail with reference to FIGS. 3 to 5.

Figure 3:
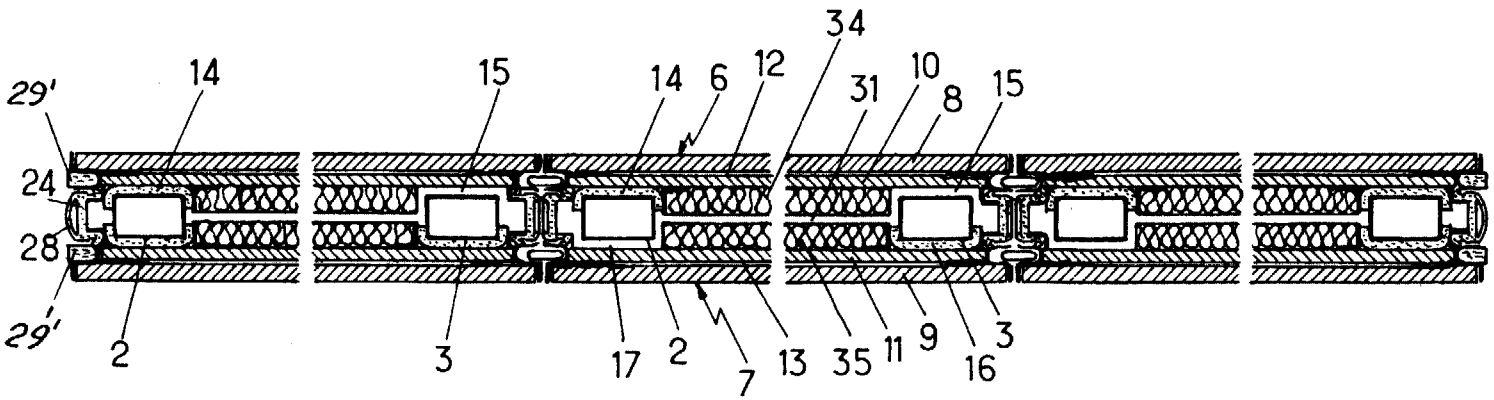
FIG. 3 is a cross-sectional view of the wall system according to the invention comprising a plurality of interconnected wall elements of FIG. 1.

As shown in FIG. 3, the wall panel 6 is composed of an outer plate 8 and an inner plate 10 which are made of conventional building materials such as wood, plywood, wood agglomerates, synthetic plastic materials or similar materials. If the wall system has to have fire retardation properties, then the material of at least the outer plate 8 is selected from a group of fireproof materials, such as plasterboard or asbestos. Similarly, the wall panel 7 is composed of an outer plate 9 and an inner plate 11. An intermediate layer 12 or 13 is provided between the outer plate 8 or 9 and the inner plate 10 or 11, respectively, the intermediate layer 12 or 13 being preferably made of synthetic plastic material and the plates 8 to 11 being attached thereto either by press-bonding or by any other conventional bonding or attachment method.

The two wall panels 6 and 7 in the assembled condition of the wall element extend in mutual parallelism and spaced from one another in the direction normal to their major surfaces, thus defining with one another an enclosed space into which the frame 1 is accepted with clearance from each of the wall panels 6 and 7. A cushion member 14 is accommodated in the clearance between the panel 6 and the upright support 2, supporting the wall panel 6 on the upright support 2, while the panel 6 and the upright support 3 define with one another a clearance 15. In a similar manner, a cushion member 16 is accommodated in the clearance between the panel 7 and the upright support 3, supporting the wall panel 7 on the upright support 3, while the panel 7 and the upright support 2 define with one another a clearance 17.

Figure 4:
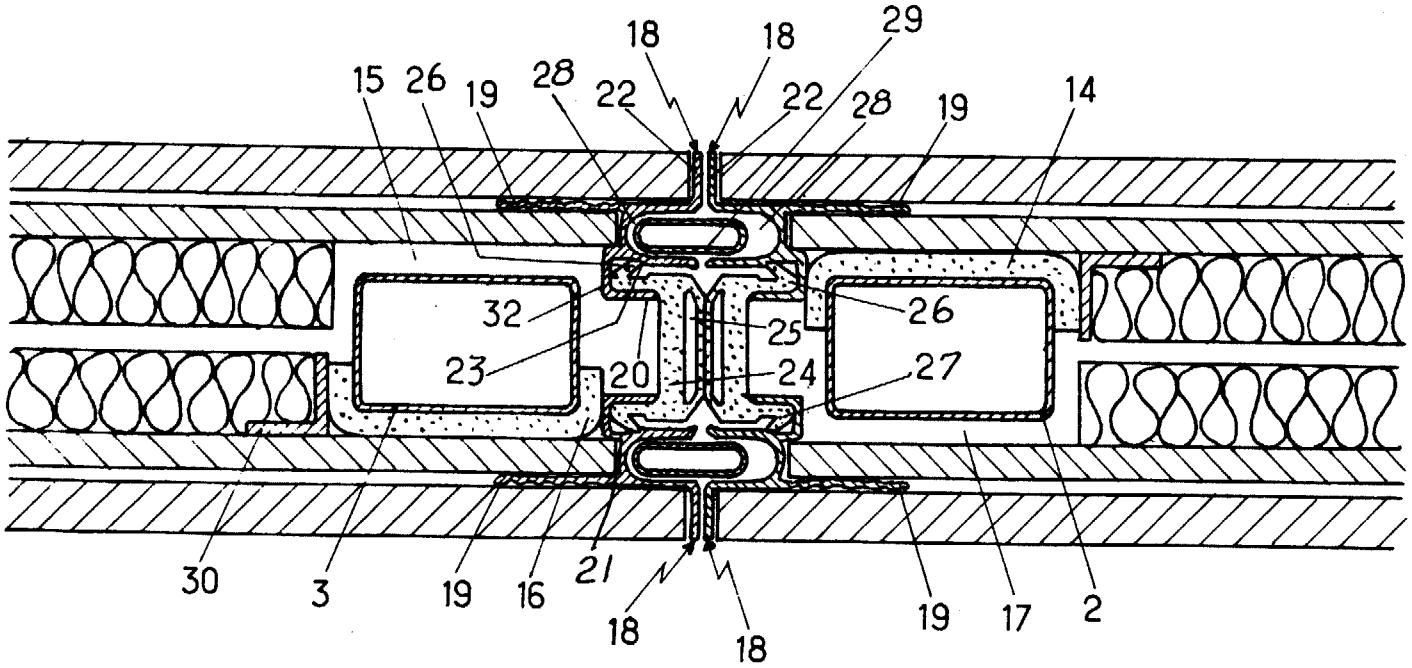
FIG. 4 is a detail of the wall system illustrated in FIG. 3.

A connecting member 18 which is shown in greater detail in FIG. 4 is provided at each of the upright marginal portions of the wall panels 6 and 7 and comprises a preferably corrugated projection 19 which is accepted in and bonded to the intermediate layer 12 or 13. The connecting member 18 further includes a portion 22 which abuts the outer plate 8 or 9, respectively, and is provided with a recess 21 into which the inner plate 10 or 11, respectively, is accepted. A further projection 20 of the connecting member 18 extends into the enclosed space defined by the wall panels 6 and 7 and bounds a groove in which a retaining projection 23 is provided. A connecting element 24, which is preferably made of resilient sound-absorbing material, includes two hook-shaped projections 26 and 27 which respectively extend into the grooves defined by the projections 20 of the connecting members 18 associated with the panels 6 and 7, respectively so that the tips of the projections 26 and 27 engage the respective retaining projections 23. Alternatively, instead of providing two separate connecting elements 24 each being associated with one wall element, a shared connecting element may be provided having twice as many projections as the previously described connecting elements, each of the hook-shaped projections 26 or 27 engaging one of the retaining projections 23 of the four connecting members 18 associated with the two adjacent wall elements whereby the wall elements are interconnected.

If the sound-proofing properties of the connecting elements 24 are to be further improved, the connecting elements 24 may be formed with hollows 25 reducing the cross-sectional area of the connecting elements 24. The connecting member 18 is further provided with a recess 28 adapted to receive an aligning member 29. When the two adjacent wall elements are brought together so that the marginal portions of the panels 6 or 7 of the two adjacent wall elements abut one another, then each aligning member 29 extends into the recess 28 of the connecting members 18 of the adjacent wall panels 6 or 7, respectively, thus aligning the panels 6 of the two adjacent wall elements with one another and similarly aligning the panels 7. Preferably, the aligning member 29 has such dimensions as to be accepted into at least one of the recesses 28 with pressure-fit so that, prior to assembling the two adjacent wall elements, the aligning member 29 is accepted into one of the recesses 28 and retained in it by friction. If the aligning member 29 is so configurated as to be received with pressure-fit into each of the cooperating recesses 28, this gives the wall system an increased stability and resistance to unintentional disengagement of the two adjacent wall elements.

In order to prevent relative movement between the frame 1 and the wall panels 6 and 7, the cushion member 14 or 16 is accommodated between an abutment surface 32 of the respective connecting member 18 and an L-shaped section 30 which is rigidly connected to the inner plate 10 or 11 of the respective panels 6 or 7.

The separate wall elements are assembled either in the production plant and transported to the building site in their assembled condition, or directly on the building site but preferably prior to erection of the wall system. The assembling operation includes inserting the cushion members 14 and 16 between the abutment surface 32 and the L-shaped section 30 provided on the respective panel 6 or 7 and introducing the upright supports 2 and 3, respectively, into the channels defined by the cushion members 14 and 16 or, alternatively, attaching the cushion members 14 and 16 to the uprights 2 and 3, respectively and inserting the cushioned upright supports 2 and 3 between the abutment surface 32 and the L-shaped section 30 provided on the respective panel 6 or 7. In this manner, the respective panel 6 is supported in cantilever fashion on the upright support 2 and the panel 7 is supported in cantilever fashion on the upright support 3. Subsequently thereto, the panels 6 and 7 are interconnected by the connecting elements 24 engaging the retaining projections 23 of the connecting members 18 so that the mutual distance of the panels 6 and 7 is set and so are the clearances 15 and 17 between the panel 6 and the upright support 3 and the panel 7 and the upright support 2. Then the aligning members 29 are inserted into the recesses 29 of the connecting members 18.

When a wall system is to be erected from a plurality of such assembled wall elements, the first one of the wall elements is connected to the existing structure extending in the direction of the contemplated wall system, and each successive adjacent wall element is moved in its upright position toward the first wall element so that the aligning members 29 enter into the free recesses 28 of the connecting members 18. When the entire wall system is erected, then all the panels 6 of the various wall elements will be mutually aligned and also all the panels 7 of the various wall elements will be similarly aligned. It is evident that in the assembled condition no sound-transmitting or thermally conductive bridges are present between the wall plates 6 and 7 but for the sound-absorbing and thermally non-conductive connecting elements 24. Despite the fact that clearances 15 and 17 are provided between the respective upright supports 2 or 3 and the panels 6 or 7, the construction is extremely stable due to the fact that the two respective adjacent panels are interconnected by the aligning members 29 so that even the cantilevered upright marginal portion of the panels 6 or 7 is prevented from yielding, being mediately, via the aligning member 29, supported on the respective upright support 2 or 3 of the adjacent wall element.

The above-discussed arrangement is quite satisfactory for permanent, immovable walls, even for those wall elements which are adjacent to the corners of the thus formed compartment where no adjacent wall element is available since the clearance 15 or 17 may be obtained by mounting the respective wall panel 6 or 7 to the existing structure. However, it is also possible for the corner wall elements, and imperative for end wall elements of a slidable wall, to provide a modified arrangement as illustrated in FIG. 3, in which an additional cushion member is provided between the otherwise cantilevered marginal portion of the wall panel 6 or 7 and the associated upright support 2 or 3. In other words, the clearance 15 or 17 is eliminated and replaced by the cushion member 14 or 16. It is evident that this expedient is necessary since otherwise there would be no support for the cantilevered marginal portion of the wall element, particularly such wall element which is used in a slidable wall. If so desired, sound-absorbing strips 33 may be accommodated in the recesses 28 which, when the slidable wall abuts the adjoining structure, provide sound and heat insulation between the two neighboring compartments. The strips 33 may be made of any sound-absorbing and thermally insulating material, felt being currently preferred.

The two associated wall panels 6 and 7 of each wall element define with one another a relatively large enclosed space. This space may be, if so desired, filled either entirely or partially with insulating material 34 or 35, preferably with glass fibres or like materials. It is currently preferred that two separate insulating layers 34 and 35 are provided, each associated with one of the panels 6 and 7, so that a gap is provided between the respective layers 34 and 35.

Figure 5:
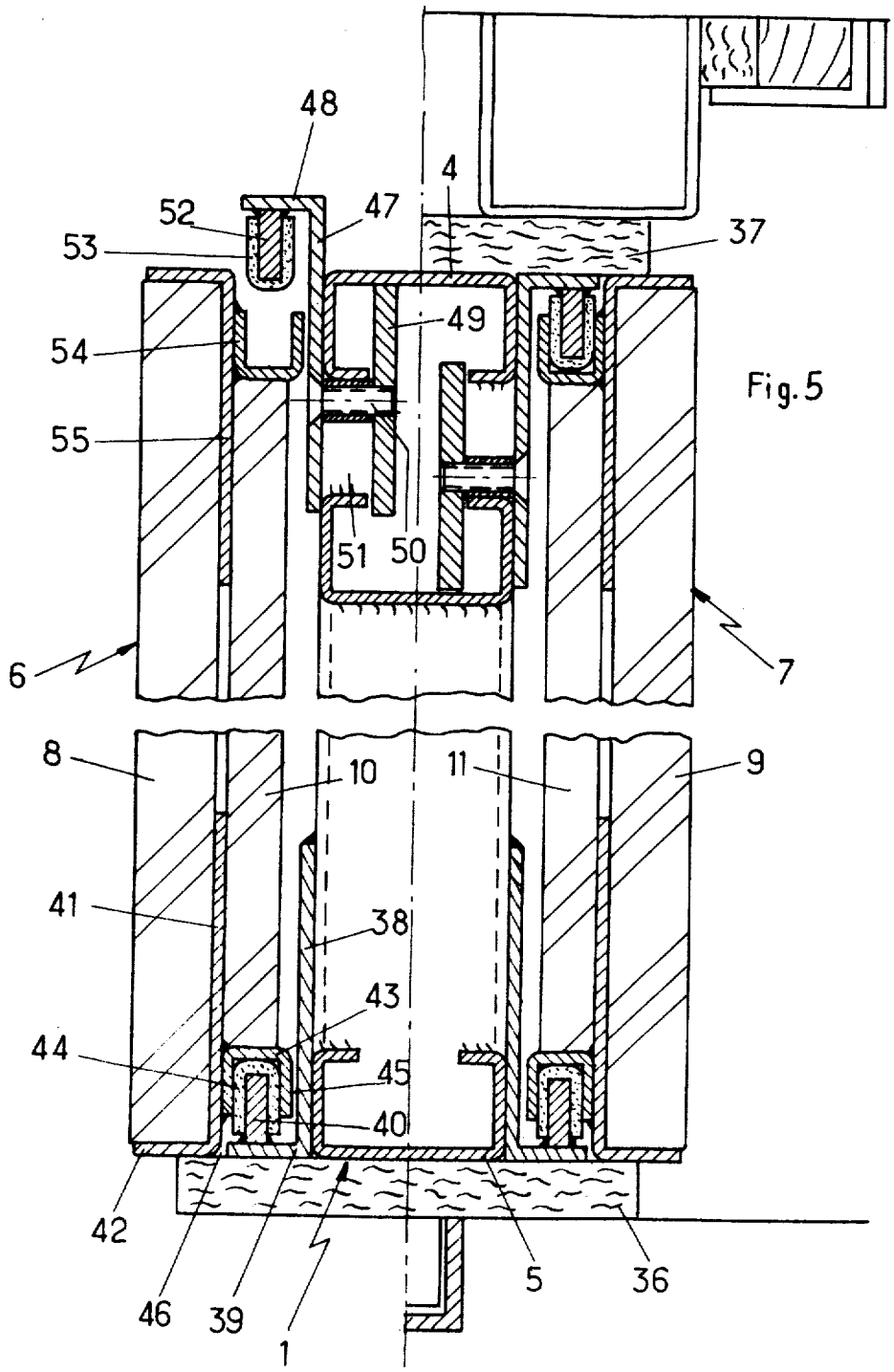
FIG. 5 is a cross-sectional view of the wall element according to the invention of FIG. 1.

Coming now to the embodiment shown in FIG. 5, it may be seen therein that a different kind of insulating arrangement may also be provided in the regions of the upper and lower end faces of each wall element. In the currently preferred embodiment of the invention, the formation of heat and sound conducting bridges between the wall panels 6 and 7 is prevented even in these regions by providing gaps between the panels 6 and 7 and the transverse bars 4 and 5.

The lower transverse bar 4 of the frame 1 is connected to the upright supports 2 and 3 or made in one piece therewith. An L-shaped section is connected to the transverse bar 4 and/or the upright supports 2 and 3 in a conventional manner, for instance by welding, and has an upright arm 38 and another arm 39 extending outwardly from the frame 1. A support rib 40 which may be either unitary with, or connected to, the arm 39 extends parallel to the arm 38. Another L-shaped section is also provided having an upright arm 41 accepted and retained between the outer plate 8 or 9 and the inner plate 10 or 11 and another arm 42 extending outwardly underneath the outer plate 8 or 9, respectively, and supporting the same. A U-shaped section 43 is attached to the inwardly directed side of the arm 41 so that the inner plate 10 or 11 is supported thereon and being provided with a downwardly directed groove having such dimensions that the support rib 40 surrounded by an insulating element 44, which may be made of foam rubber or similar material, is snugly received therein. When the rib 40 and the insulating element 44 are fittingly received in the groove of the section 43, the arms 39 and 42 of the two L-shaped sections are spaced from one another by a gap 46, and the arm 38 is spaced from the section 43 by a gap 45. As a result of the presence of the gaps 45 and 46 and of the insulating element 44, excellent sound and heat insulating properties are obtained.

The upper transverse bar arrangement generally corresponds to the just described lower transverse bar arrangement with one exception, namely that the inner L-shaped section 47, 48 is mounted for movement in the vertical direction, instead of being rigidly connected to the frame 1. This particular arrangement includes a counter plate 49 connected to the arm 47 of the L-shaped section by connecting bolts 50 which are accepted in a vertical elongated cutout 51 of the transverse bar 4 so as to be movable between an upper position shown in the left half of the FIG. 5 and a lower position illustrated in the right half thereof. A support rib 52 corresponding to the previously described support rib 40 is provided with an insulating element 53, and a U-shaped section 54 is connected to the inwardly directed side of an arm 55, the section 54 and the arm 55 being similar to the previously described section 43 and arm 41. As a result of this arrangement, it is possible to arrange the panels 6 and 7 on the lower support rib 40 as previously described while the L-shaped section 47, 48 is in its upper position, and subsequently thereto also attach the panels 6 and 7 in the upper regions thereof by lowering the L-shaped section 47, 48 so that the support rib 52 with the insulating element 53 attached thereto is received in the groove of the section 44. The particular advantage of this arrangement is that the assembly of the wall section from the various components thereof, such as the frame 1 and the two wall panels 6 and 7, may be accomplished without any special tools. Consequently, it is possible to deliver the above-mentioned components to the construction site in their disassembled condition to be assembled in situ. Another advantage obtained by this arrangement is that any one of the panels 6 or 7 can be easily removed from the assembled wall element for repair purposes or in order to be exchanged for a different one.

According to a modified embodiment of the invention, which is not illustrated, a shared U-shaped section may be provided instead of the two separate L-shaped lower sections of the two separate L-shaped upper sections. Of course, the lower U-shaped section would be rigidly connected to the frame 1, while the upper U-shaped section would be mounted on the frame 1 for movement in the vertical direction. In that case, of course, the panels 6 and 7 will have to be mounted simultaneously.

The above-described wall element is particularly suitable for use as a sliding wall, either by itself or in combination with several other wall elements. Of course, in this event, suitable supporting sliding arrangement will have to be provided, which is well known in the building industry. Such arrangement may, for instance, include an overhead rail and a plurality of supporting rollers mounted on the wall element and adapted to travel on the overhead rail, or a bottom rail and a plurality of rollers provided underneath or laterally of the lower marginal portion of the respective wall element and adapted to roll on the bottom rail. Instead of providing separate rollers, they may be grouped in overhead or bottom carriages. Also, as an alternative, the lower rollers may be replaced by a layer of synthetic plastic material whose surface is relatively smooth and, consequently, whose coefficient of friction is relatively low, so that when the layer slides along the bottom rail, which may also be made of, or provided with a layer of, such low-friction material, the frictional resistance to the sliding movement of the wall element will be minimal.

It wil be understood that each of the elements described above, or two or more together, may also find a useful application in other types of wall systems differing from the types described above.

While the invention has been illustrated and described as embodied in a wall system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a wall system, a composite wall element comprising two substantially parallel transversely spaced panels; a frame including two upright supports disposed with clearances between said panels, and connecting bars interconnecting said upright supports, each panel being separated by a gap from the respective one of said connecting bars; means for supporting one of said panels only on one of said upright supports and the other panel only on the other upright support; means for attaching a respective panel to said frame, including a first mounting section attached to said frame in region of one of said connecting bars; a second mounting section attached to said respective panel and supported on said first mounting section, a third mounting section attached to said respective panel, and a fourth mounting section mounted on said frame in the region of the other connecting bar for movement between an extended position in which it is disengaged from said third mounting section and a retracted position in which it engages said third mounting section; and means for mechanically connecting said panels to one another, said connecting means having thermally and acoustically insulating properties, whereby said connecting means, together with said clearances between said one panel and said other upright support and between said other panel and said one upright support, thermally and acoustically insulate said panels from one another.

2. A wall system as defined in claim 1, wherein each of said panels comprises at least two mutually interconnected plates.

3. A wall system as defined in claim 1, wherein said connecting means includes a connecting element of sound-absorbing material connecting said panels and spacing the same from one another.

4. A wall system as defined in claim 3, wherein said connecting element is formed with at least one internal hollow.

5. A wall system as defined in claim 3, wherein said connecting means further comprises a plurality of connecting members, each rigidly connected to one of said panels; and wherein said connecting element includes at least two projections, each engaging one of said connecting members.

6. A wall system as defined in claim 5, wherein each of said connecting members at least partially surrounds an upright marginal portion of said panel.

7. A wall system as defined in claim 5, wherein each of said connecting members is provided with at least one groove formed with a retaining projection therein;

and wherein said projections of said connecting element are of a hook-shaped configuration and include a tip engaging the respective retaining projection when said hook-shaped projection is accommodated in said groove.

8. A wall system as defined in claim 1, wherein said connecting means further comprises a plurality of connecting members, each rigidly connected to one of said panels and each having an abutment surface; and further comprising at least one L-shaped section attached to each of said panels, said supporting means being accommodated between said abutment surface and said L-shaped section so that relative movement of said panels and said upright supports is prevented.

9. A wall system as defined in claim 1, and further comprising at least one additional second means accommodated in the other of said clearances between said one of said upright supports and the other of said panels.

10. A wall system as defined in claim 1, comprising an additional composite wall element similar to said composite wall element and located adjacent thereto in substantially the same general plane, said one upright support of one of said composite wall elements and said other upright support of the other composite wall element being close to one another; and wherein said connecting means also connects said composite wall elements to one another and cooperates with the supporting means associated with said close upright supports to prevent displacement of said panels relative to said upright supports.

11. A wall system as defined in claim 10, wherein said connecting means further comprises a plurality of elongated connecting members, each connected to one of said panels and provided with a longitudinally extending recess; and an elongated aligning member accepted into said recesses of two adjacent connecting members for aligning said panels with one another.

12. A wall system as defined in claim 1, and further comprising insulating material at least partially filling the space between said panels.

13. A wall system as defined in claim 12, wherein said insulating material is in form of an insulating layer attached to an inner side of at least one of said panels which faces the other panel and wherein the thickness of said layer is less than the distance between said panels.

14. A wall system as defined in claim 12, wherein said insulating material is in form of an insulating layer attached to a respective inner side of each of said panels; and wherein the combined thickness of said layers is less than the distance between said panels.

* * * * *